US011696631B2

(12) United States Patent
Stotesbury

(10) Patent No.: US 11,696,631 B2
(45) Date of Patent: Jul. 11, 2023

(54) TOOTHBRUSH PROTECTOR WITH AEROSOL RESTRICTOR

(71) Applicant: Dean Stotesbury, Torrance, CA (US)

(72) Inventor: Dean Stotesbury, Torrance, CA (US)

( * ) Notice: Subject to any disclaimer, the term of this patent is extended or adjusted under 35 U.S.C. 154(b) by 182 days.

(21) Appl. No.: 16/946,614

(22) Filed: Jun. 29, 2020

(65) Prior Publication Data

US 2021/0401152 A1 Dec. 30, 2021

(51) Int. Cl.

| | |
|---|---|
| ***A45D 44/18*** | (2006.01) |
| ***A46B 17/04*** | (2006.01) |
| ***A45D 44/00*** | (2006.01) |
| *A46B 9/04* | (2006.01) |

(52) U.S. Cl.

CPC ..... *A45D 44/18* (2013.01); *A45D 44/00* (2013.01); *A46B 17/04* (2013.01); *A46B 9/04* (2013.01); *A46B 2200/1066* (2013.01)

(58) Field of Classification Search

CPC ..... A45D 44/18; A46B 17/00; A46B 17/02; A46B 17/04; A46B 2200/1066; A46B 2200/1073; A46B 2200/108; A46B 2200/1086; A46B 2200/405; A46B 9/04; A46B 9/045; A46B 11/003; A46B 11/0017

USPC ..... 132/308; 220/212, 370, 369, 367.1, 376, 220/913; 206/581, 361, 362, 362.2, 206/362.1; 15/247, 167.1

See application file for complete search history.

(56) References Cited

U.S. PATENT DOCUMENTS

| | | | | |
|---|---|---|---|---|
| 3,977,743 | A * | 8/1976 | Harris | A47K 5/18 312/207 |
| 5,505,301 | A * | 4/1996 | Foley | A45D 44/18 206/823 |
| 5,509,168 | A * | 4/1996 | Butler | A46B 17/04 24/562 |
| 5,692,603 | A | 12/1997 | Stotesbury | |
| 7,059,471 | B2 * | 6/2006 | Fattori | B65D 25/20 206/362.2 |
| 2014/0202918 | A1 * | 7/2014 | Huxford | A61M 15/009 206/570 |
| 2014/0252925 | A1 * | 9/2014 | Tooma | A46B 17/00 312/207 |
| 2017/0035254 | A1 * | 2/2017 | Ogbuagu | A47K 1/09 |

* cited by examiner

*Primary Examiner* — Cris L. Rodriguez
*Assistant Examiner* — Karim Asqiriba
(74) *Attorney, Agent, or Firm* — Law Office of Scott C Harris

(57) ABSTRACT

A toothbrush holder which has a case having an inside portion adapted and sized for holding a toothbrush in the inside portion. The bottom portion of the case having at least one opening enabling liquids to drain from an inside the case. The top portion of the case having an aerosol restrictor, which allows liquid from the inside of the case to evaporate through openings in the aerosol restrictor, but which prevents aerosolized liquids from an outside of the case from reaching the inside of the case. The aerosol restrictor includes multiple inwardly facing baffles, each baffle blocking a portion of an opening on the top portion of the case, and the multiple baffles collectively blocking any direct path for aerosolized droplets between an outside of the case and the inside of the case. Each baffle includes an upwardly facing spike which forms a high point of the baffle reaching towards a top of the case and a downwardly facing indent which forms a low portion of the baffle.

9 Claims, 3 Drawing Sheets

TOOTHBRUSH PROTECTOR WITH AEROSOL RESTRICTOR

BACKGROUND 265 million Americans buy approximately 3 to 4 manual toothbrushes a year. That equates to over 750 million manual toothbrushes purchased a year in the US. It is important to keep toothbrushes clean, since they go into a user's mouth. However, toothbrush users store toothbrushes in a bathroom, which the is an inherently unclean place.

SUMMARY OF THE INVENTION

The inventor recognized, however, that there are a number of drawbacks with the current systems.

The inventor recognized that liquid in bathrooms becomes aerosolized, causing droplets to form in the air. Droplets can be caused by running water, flushing toilets, and user actions, such as blowing their nose, coughing, sneezing or similar actions. Droplets from coughing and sneezing range in size from 0.35 to 10 microns and are large enough where most of them fall downward.

If a toothbrush is exposed to this environment, the inventor recognized that the user of the toothbrush might be brushing their teeth with toilet water, In an embodiment, a toothbrush case is disclosed that has an "Aerosol Restrictor" catches the droplets before they can enter the case. The "Aerosol Restrictor" prevents contaminated droplets from entering the case and settling on your toothbrush, yet still allowing moisture to evaporate or drain.

When moisture evaporates it turns to a gas (0.10 microns and smaller). The gas from the evaporating liquids inside the container float past the Aerosol Restrictor, but the droplets from the outside are denied entry.

DETAILED DESCRIPTION

Figure 1:
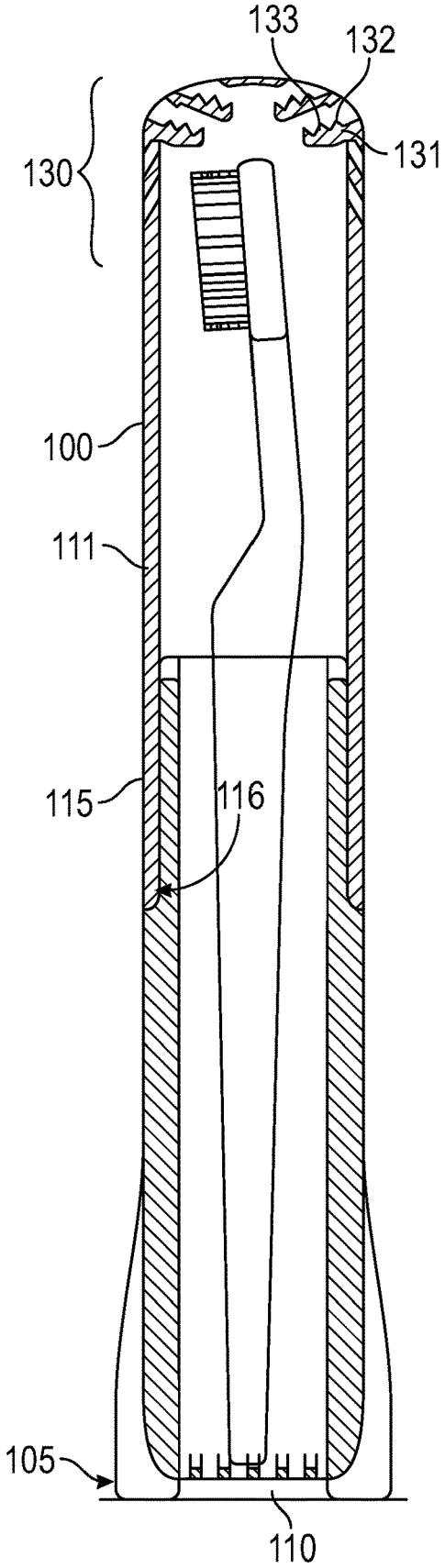
FIG. 1 shows a first embodiment of a case with an aerosol restrictor.

The inventor recognized that toothbrushes are usually kept in the bathroom. The bathrooms typically have a number of plumbing fixtures. Any plumbing fixture which moves water can create some amount of aerosolized water in the air.

Typically, people leave their toothbrush open to the air, so that it can dry between uses.

However, the inventor recognized that aerosolized droplets can tend to land on the toothbrush. On the other hand, when toothbrushes are covered, the toothbrushes can stay wet and grow mold.

In an embodiment, an aerosol restrictor is used in a toothbrush holder, in a way that prevents aerosolized liquid from reaching the toothbrush in the holder, yet allows liquid inside the holder to evaporate and also drain out the bottom.

An embodiment of the toothbrush holder 100, with an exemplary toothbrush, is shown in the figures. The toothbrush holder 100 is formed to have a bottom portion 105 which forms a stand which allows the toothbrush and stand 100 to be held upright. Openings 110 are located at the bottom most portion of that bottom portion 105, enabling liquid inside the holder 100, e.g., liquid on the toothbrush, to pass out through the bottom openings 110. The bottom portion 105 of the holder 100 mates with a top portion 111 of the holder at an interface area 115. The bottom portion 105 includes a beveled area 116 which mates with the top portion 110, so that the outer surface of the holder 100 has a constant outer diameter between the bottom portion 105 and the top portion 111.

The top most portion of the top portion 110 includes an aerosol restrictor 130. The aerosol restrictor 130 is formed of plural baffles 131, 135, 136, 137, extending from the edges of the case toward the center. Each baffle includes a series of alternating spikes 132 and indents 133. Each baffle such as 131 extends from the outside of the toothbrush device towards the inner area, and each includes the spikes and indents. Liquid, such as aerosolized liquid drops shown as 200 in FIG. 2, land on the spikes 132 are held by the portion 132 and eventually seep into the indents 133 where the liquid is held and allowed to evaporate. There is no direct line for any liquid droplet to pass directly into the inside of the toothbrush holder, liquid droplets are touched by the baffles, and collect in the indents of the baffles.

The angles on the baffles 131, 135 are set to allow evaporation only and to restrict aerosols from entering device.

Figure 2:
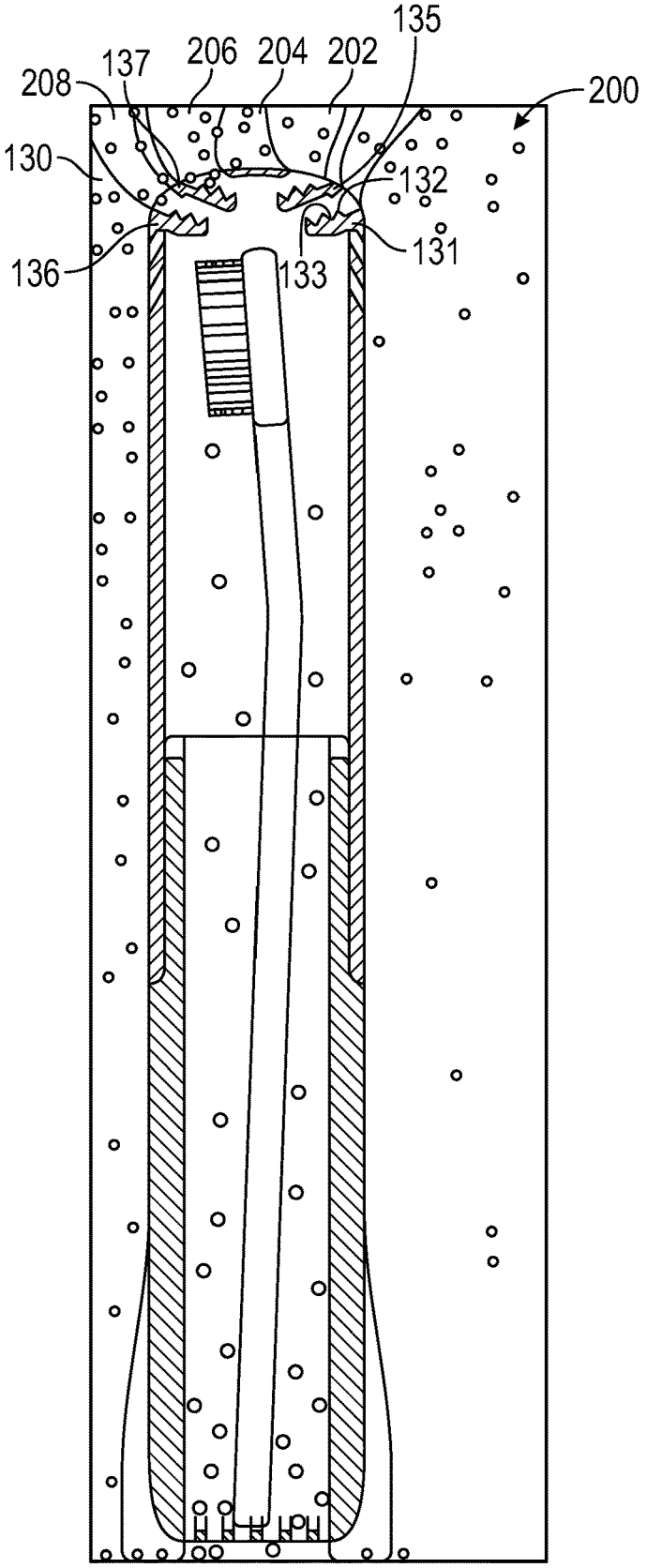
FIG. 2 shows a side view of the case.

FIG. 2 shows a close-up of the aerosol restrictor 130, and shows aerosolized droplets such as 200, which are always located within the bathroom area. The aerosolized droplets may enter the toothbrush holder in areas such as 202, 204, 206, 208. However, all of these areas of entry are blocked by the baffles that contain the droplets and direct them into the indents in the baffles, forcing the liquid to settle into the indents such as 133 where they are allowed to evaporate.

Each baffle includes multiple spikes and multiple indents, to trap and contain the aerosolized liquid.

Figure 3:
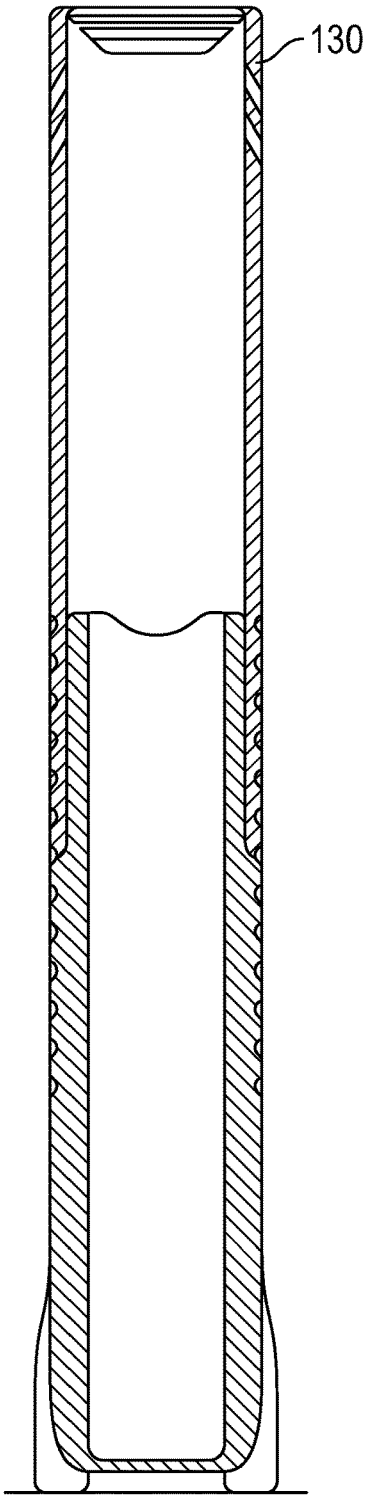
FIG. 3 shows a closeup view of the aerosol restrictor.

FIG. 3 illustrates a side view of the toothbrush holder, showing the aerosol restrictor 130 at the top from the side. Note that the aerosol restrictor extends down into the area towards the toothbrush head, but does not quite reach the toothbrush head.

Figure 4:
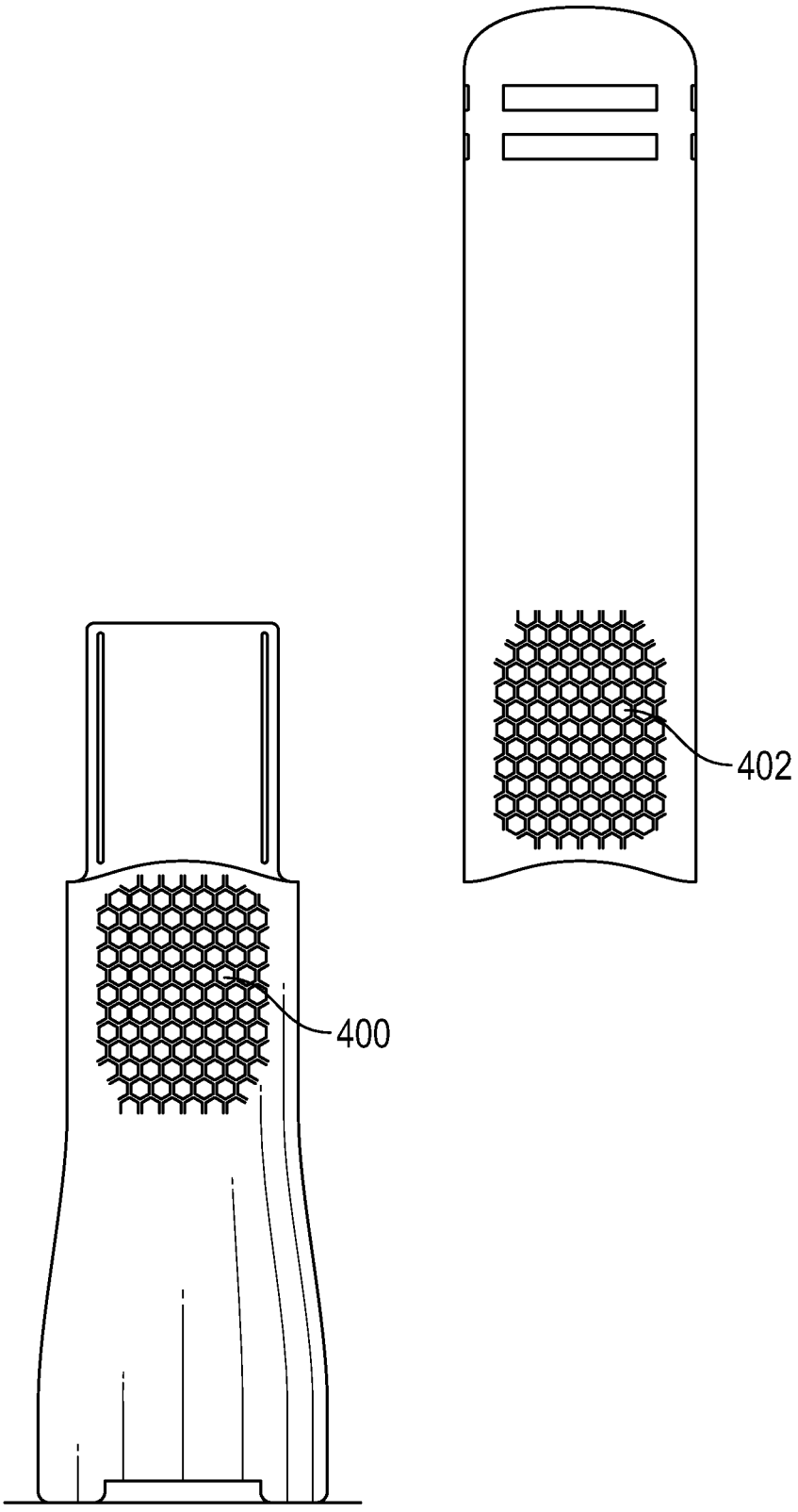
FIG. 4 shows views of the toothbrush holder.

FIG. 4 shows how the inner cover an outer cover can be disassembled from one another, the two covers include gripping portions 400, 402 which allow them to be grasped to be removed from one another.

In one embodiment, a medical-grade antimicrobial silver or copper is embedded into the case to help kill bacteria and keep the case clean. This keeps the parts clean with no batteries, cords, UV lights, etc. The case is compact and light enough to be extremely portable. It is cleanable in a dishwasher or warm running water.

The system is personal in that it stores one toothbrush per holder. This eliminates the comingling of your toothbrush with other brushes—as in using a glass or group rack.

It keeps the toothbrush upright which allows liquids from the brush head to easily drain.

The previous description of the disclosed exemplary embodiments is provided to enable any person skilled in the art to make or use the present invention. Various modifications to these exemplary embodiments will be readily apparent to those skilled in the art, and the generic principles defined herein may be applied to other embodiments without departing from the spirit or scope of the invention. Thus, the present invention is not intended to be limited to the embodiments shown herein but is to be accorded the widest scope consistent with the principles and novel features disclosed herein.

What is claimed is:

1. A toothbrush system, comprising:

a toothbrush, a case having an inside portion adapted and sized for holding the toothbrush with a head portion having bristles in the inside portion of the case, the case having a bottom portion with a stand which holds the case vertically, the bottom portion of the case adapted for housing a bottom of the toothbrush, and a top portion of the case adapted for housing a top portion of the toothbrush which has the head portion with the bristles, and the top portion having at least one opening therein;

the bottom portion of the case having at least one opening enabling liquids to drain from an inside the case; and the top portion of the case having an aerosol restrictor, which allows liquid from the inside of the case to evaporate through the at least one opening, but which prevents aerosolized liquids from an outside of the case from reaching the inside of the case and prevents aerosolized liquids from an outside of the case from reaching the head portion of the toothbrush therein, the aerosol restrictor located in the top portion of the case, between the at least one opening and the bristles of the toothbrush, in a location spaced from and not touching the bristles of the toothbrush, the aerosol restrictor includes at least one inwardly facing baffle extending from the inside of the case towards the bristles of the toothbrush, each baffle having a portion which traps aerosolized liquid particles.

2. The toothbrush system as in claim 1, wherein the aerosol restrictor includes multiple inwardly facing baffles, each baffle blocking a portion of the opening on the top portion of the case, and the multiple baffles collectively blocking any direct path for aerosolized droplets between an outside of the case though the at least opening, to the inside of the case.

3. The toothbrush system as in claim 2, wherein each baffle includes an upwardly facing spike which forms a high point of the baffle reaching towards a top of the case and a downwardly facing indent which forms a low portion of the baffle, the indent having a horizontal liquid holding area to collect and hold liquid created from the aerosolized droplets.

4. The toothbrush system as in claim 3, wherein there is an indent between two adjacent spikes, and there are multiple spikes and multiple indents on each baffle.

5. The toothbrush system as in claim 2, wherein the baffles include structure which causes aerosolized liquid to land on a spike of the baffle, and to seep into an indent of the baffle where the liquid from the aerosolized droplets is held in a liquid holding area adjacent the indent between the baffles and eventually evaporates.

6. The toothbrush system as in claim 1, wherein the bottom portion of the toothbrush holder is separable from the top portion of the toothbrush holder.

7. The toothbrush system as in claim 1, wherein the aerosol restrictor is formed of an extended surface that extends into an area towards the toothbrush head but does not touch the toothbrush head.

8. The toothbrush system as in claim 7, wherein the aerosol restrictor is formed with baffles with spikes and indents therein, the indents forming liquid holding areas where liquid settles into the liquid holding areas, is held in the liquid holding areas, and is allowed to evaporate from the liquid holding areas.

9. The toothbrush system as in claim 8, where the spikes extend substantially towards the top of the toothbrush holder, and the liquid holding areas are horizontal to hold the liquid in the liquid holding areas.

* * * * *